US009047736B2

(12) United States Patent
Lempel et al.

(10) Patent No.: US 9,047,736 B2
(45) Date of Patent: Jun. 2, 2015

(54) SYSTEM AND METHOD FOR WAGERING BADGES

(75) Inventors: Eric Lempel, Hayward, CA (US); Jennifer Cho, Redwood City, CA (US); Dawn Cindy De Guzman, Pleasant Hill, CA (US)

(73) Assignee: SONY COMPUTER ENTERTAINMENT AMERICA LLC, Foster City, CA (US)

( * ) Notice: Subject to any disclaimer, the term of this patent is extended or adjusted under 35 U.S.C. 154(b) by 751 days.

(21) Appl. No.: 12/420,429

(22) Filed: Apr. 8, 2009

(65) Prior Publication Data

US 2010/0261520 A1 Oct. 14, 2010

(51) Int. Cl.
*A63F 9/24* (2006.01)
*G07F 17/32* (2006.01)

(52) U.S. Cl.
CPC ..... *G07F 17/3281* (2013.01); *G07F 17/32* (2013.01)

(58) Field of Classification Search
USPC ..... 463/42
See application file for complete search history.

(56) References Cited

U.S. PATENT DOCUMENTS

| | | | | |
|---|---|---|---|---|
| 4,787,051 | A | 11/1988 | Olson | |
| 4,843,568 | A | 6/1989 | Krueger | |
| 5,128,671 | A | 7/1992 | Thomas, Jr. | |
| 5,528,265 | A | 6/1996 | Harrison | |
| 5,928,082 | A | 7/1999 | Clapper, Jr. | |
| 6,157,368 | A | 12/2000 | Faeger | |
| 6,375,572 | B1 | 4/2002 | Masuyama | |
| 6,616,531 | B1 | 9/2003 | Mullins | |
| 6,712,697 | B2 | 3/2004 | Acres | |
| 6,729,884 | B1 * | 5/2004 | Kelton et al. | 434/236 |
| 6,754,636 | B1 | 6/2004 | Walker et al. | |
| 7,039,603 | B2 | 5/2006 | Walker et al. | |
| 7,407,434 | B2 | 8/2008 | Thomas et al. | |
| 7,429,215 | B2 | 9/2008 | Rozkin et al. | |
| 2002/0085097 | A1 | 7/2002 | Colmenarez et al. | |
| 2003/0083943 | A1 | 5/2003 | Adams et al. | |
| 2004/0007618 | A1 | 1/2004 | Oram et al. | |
| 2004/0073446 | A1 * | 4/2004 | Snow | 705/1 |
| 2004/0083173 | A1 | 4/2004 | Reddihough et al. | |
| 2004/0181463 | A1 | 9/2004 | Goldthwaite et al. | |
| 2004/0210634 | A1 | 10/2004 | Ferrer et al. | |
| 2004/0212589 | A1 | 10/2004 | Hall et al. | |

(Continued)

OTHER PUBLICATIONS

Bolt, R.A., "Put-that-there": voice and gesture at the graphics interface, Computer Graphics, vol. 14, No. 3 (ACM SIGGRAPH Conference Proceedings) Jul. 1980, pp. 262-270.

(Continued)

*Primary Examiner* — Yu-Hsi D Sun
(74) *Attorney, Agent, or Firm* — Frommer Lawrence & Haug LLP; William S. Frommer

(57) ABSTRACT

A method for wagering badges. The method includes establishing badges representing an associated event, such as a window of time that the badge was available. A predetermined criteria for the badges are established, such as an activity required for a gamer to obtain a particular badge, and a determination is made that a gamer is entitled to the badge, based on the predetermined criteria. Similarly, other gamers can also obtain badges by meeting the criteria for the badge. Each gamer, is associated with their badges and a wager or trade between gamers can be established whereby the gamers wager or trade chosen badges. Ownership of the wagered badges is then transferred based on the outcome of the wager or trade.

17 Claims, 6 Drawing Sheets

(56) References Cited

U.S. PATENT DOCUMENTS

| | | | | |
|---|---|---|---|---|
| 2005/0121514 | A1 | 6/2005 | Hovsepian | |
| 2006/0063587 | A1 | 3/2006 | Manzo | |
| 2006/0111979 | A1 | 5/2006 | Chu | |
| 2006/0287105 | A1 | 12/2006 | Willis | |
| 2007/0077981 | A1 | 4/2007 | Hungate et al. | |
| 2007/0173309 | A1 | 7/2007 | Rigsby | |
| 2007/0173321 | A1* | 7/2007 | Shen et al. | 463/40 |
| 2007/0198418 | A1 | 8/2007 | MacDonald et al. | |
| 2007/0213124 | A1 | 9/2007 | Walker et al. | |
| 2008/0046347 | A1 | 2/2008 | Smith et al. | |
| 2008/0059304 | A1 | 3/2008 | Kimsey | |
| 2008/0077488 | A1 | 3/2008 | Main et al. | |
| 2008/0154898 | A1 | 6/2008 | Cheng et al. | |
| 2008/0167130 | A1 | 7/2008 | Kroeckel et al. | |
| 2008/0220876 | A1* | 9/2008 | Mehta et al. | 463/42 |
| 2008/0257958 | A1 | 10/2008 | Rothwell et al. | |
| 2008/0280684 | A1* | 11/2008 | McBride et al. | 463/42 |
| 2008/0320041 | A1 | 12/2008 | Engelsma et al. | |
| 2009/0063283 | A1 | 3/2009 | Kusumoto et al. | |
| 2010/0017278 | A1 | 1/2010 | Wilen et al. | |
| 2010/0216553 | A1 | 8/2010 | Chudley et al. | |
| 2010/0240461 | A1* | 9/2010 | Rasmussen et al. | 463/43 |
| 2013/0091055 | A1 | 4/2013 | Doran et al. | |

OTHER PUBLICATIONS

DeWitt, Thomas and Edelstein, Phil, "Pantomation: A System for Position Tracking," Proceedings of the 2nd Symposium on Small Computers in the Arts, Oct. 1982, pp. 61-69.

MC Insight—"Advertising and Video Games", Jul. 2008, 24 pages, downloaded from http://www.mediacontacts.com/wp-content/uploads/mc_insight_advergaming.pdf.

Sinclair, Brendan—"Democratic presidential candidate discloses costs related to monthlong campaign in 18 games across 10 battleground states", Oct. 2008, 1 page, downloaded from http://www.gamespot.com/news/6200232/obamas-in-game-ad-bill-445k.

* cited by examiner

SYSTEM AND METHOD FOR WAGERING BADGES

BACKGROUND

1. Field of the Invention

The present invention relates generally to a system and method for obtaining and wagering electronic collector's items (badges). More specifically, the present invention is directed to enabling gamers to wager badges between one another and to challenge each other to contests.

2. Background Discussion

Games in general typically provide a limited number of ways and incentives to play and win. There is a need to continually develop games that provide additional ways to play, win opportunities, and incentives for the players to continue playing and make the game more fun and exciting.

For example, when playing video games online, typically the assets that the player could offer as a wager to another player would be either (a) points, or (b) in-game items.

SUMMARY

Accordingly, the present invention is directed to a method and apparatus for wagering badges in competition (a contest between two or more players) and/or challenges (a player challenges another player to achieve a goal).

One embodiment of the present invention is directed to a method for transacting, or wagering, one or more symbols, or electronic collector's items, or badges. The method includes establishing one or more symbols (badges) representing an associated event, such as a window of time that the badge was available. A predetermined criteria for the symbols (badges) is established, (i.e., what activity is required for a gamer to obtain a particular badge) and a determination is made that a user is entitled to the particular symbol, or badge, based on the predetermined criteria. Similarly, other users can also obtain badges by meeting the criteria for the particular badge. Each user, or gamer, is associated with their badges and a wager, or transaction (such as a trade or a challenge or a competition) between gamers can be established whereby the gamers wager, or put at stake, chosen badges. Ownership of the wagered badges is then transferred based on the outcome of the wager.

Another embodiment of the present invention is directed to the method described above wherein the predetermined criteria are related to a time period that a particular symbol (badge) is available for acquisition by one or more users. For example a window of time, or particular day, in which the badge may be obtained by a gamer.

Yet another embodiment of the present invention is directed to the method described above wherein the predetermined criteria is related to activities by one or more users. For example a badge is obtained by a user playing a certain game for at least a pre-set number of hours.

Yet another embodiment of the present invention is directed to the method described above wherein selected symbols, or badges, are associated with a skill level.

Yet another embodiment of the present invention is directed to the method described above and furthermore establishing an electronic escrow account for the gamers to store the wagered badges. This provides an electronic escrow for the badges that are wagered thereby ensuring that the winner of the wager actually receives the won badges.

Yet another embodiment of the present invention is directed to the method described above wherein the transaction, or wager, includes an activity between the first user and the second user. The activity between the gamers is a contest of some type in which the gamers compete against one another.

Yet another embodiment of the present invention is directed to the method described above wherein the transaction, or wager, includes an activity by one of the gamers. This activity may be a challenge by one gamer for another gamer to accomplish a goal or reach a milestone.

Yet another embodiment of the present invention is directed to the method described above wherein establishing the transaction, or wager includes identifying items and/or symbols to be transacted (i.e., identify the content to be wagered, or put at stake) and determining whether to transfer the identified items and/or symbols based on the transaction (i.e., determining who won the wager).

Yet another embodiment of the present invention is directed to the method described above and furthermore establishing an indication associated with each symbol, or badge, that indicates a manner in which the badge was obtained. This may be for example, an indication whether the badge was earned or whether the badge was won in a competition or wager.

Yet another embodiment of the present invention is directed to the method described above wherein each symbol, or badge, includes an historical profile. The profile may indicate previous owners of the badge or wagers in which the badge was part of.

Yet another embodiment of the present invention is directed to the method described above wherein the symbols, or badges, include audio data.

Yet another embodiment of the present invention is directed to the method described above furthermore, monitoring an ownership status of the symbols, or badges. This enables a previous owner of a badge to see who has the badge currently and a sequence of owners since the gamer lost the badge.

Yet another embodiment of the present invention is directed to the method described above wherein each symbol, or badge, has an associated class. The class may be based on a level of difficulty or a skill level to obtain the badge.

Yet another embodiment of the present invention is directed to the method described above wherein each symbol, or badge has an associated number. This may identify a quantity of the badge type available. For example the badge may be in a series in which only 100 were made available.

Yet another embodiment of the present invention is directed to the method described above further associating advertising information with a symbol, or a badge. This may include sponsorship information related to a third party who provides the badge.

Yet another embodiment of the present invention is directed to the method described above further associating a particular status with a symbol, or badge. The status determines a type of transaction associated with the symbol, or badge.

Yet another embodiment of the present invention is directed to the method described above wherein badges, or symbols may be traded independent of a wager.

Other embodiments of the present invention include the methods described above but implemented using apparatus or programmed as computer code to be executed by one or more processors operating in conjunction with one or more electronic storage media.

BRIEF DESCRIPTION OF THE DRAWINGS

To the accomplishment of the foregoing and related ends, certain illustrative aspects of the invention are described herein in connection with the following description and the annexed drawings. These aspects are indicative, however, of but a few of the various ways in which the principles of the invention may be employed and the present invention is intended to include all such aspects and their equivalents. Other advantages, embodiments and novel features of the invention may become apparent from the following description of the invention when considered in conjunction with the drawings. The following description, given by way of example, but not intended to limit the invention solely to the specific embodiments described, may best be understood in conjunction with the accompanying drawings, in which.

DETAILED DESCRIPTION

It is noted that in this disclosure and particularly in the claims and/or paragraphs, terms such as "comprises," "comprised," "comprising," and the like can have the meaning attributed to it in U.S. patent law; that is, they can mean "includes," "included," "including," "including, but not limited to" and the like, and allow for elements not explicitly recited. Terms such as "consisting essentially of" and "consists essentially of" have the meaning ascribed to them in U.S. patent law; that is, they allow for elements not explicitly recited, but exclude elements that are found in the prior art or that affect a basic or novel characteristic of the invention. These and other embodiments are disclosed or are apparent from and encompassed by, the following description. As used in this application, the terms "component" and "system" are intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a server and the server can be a component. One or more components may reside within a process and/or thread of execution and a component may be localized on one computer and/or distributed between two or more computers.

Furthermore, the detailed description describes various embodiments of the present invention for illustration purposes and embodiments of the present invention include the methods described and may be implemented using one or more apparatus, such as processing apparatus coupled to electronic media. Embodiments of the present invention may be stored on an electronic media (electronic memory, RAM, ROM, EEPROM) or programmed as computer code (e.g., source code, object code or any suitable programming language) to be executed by one or more processors operating in conjunction with one or more electronic storage media.

Figure 1:
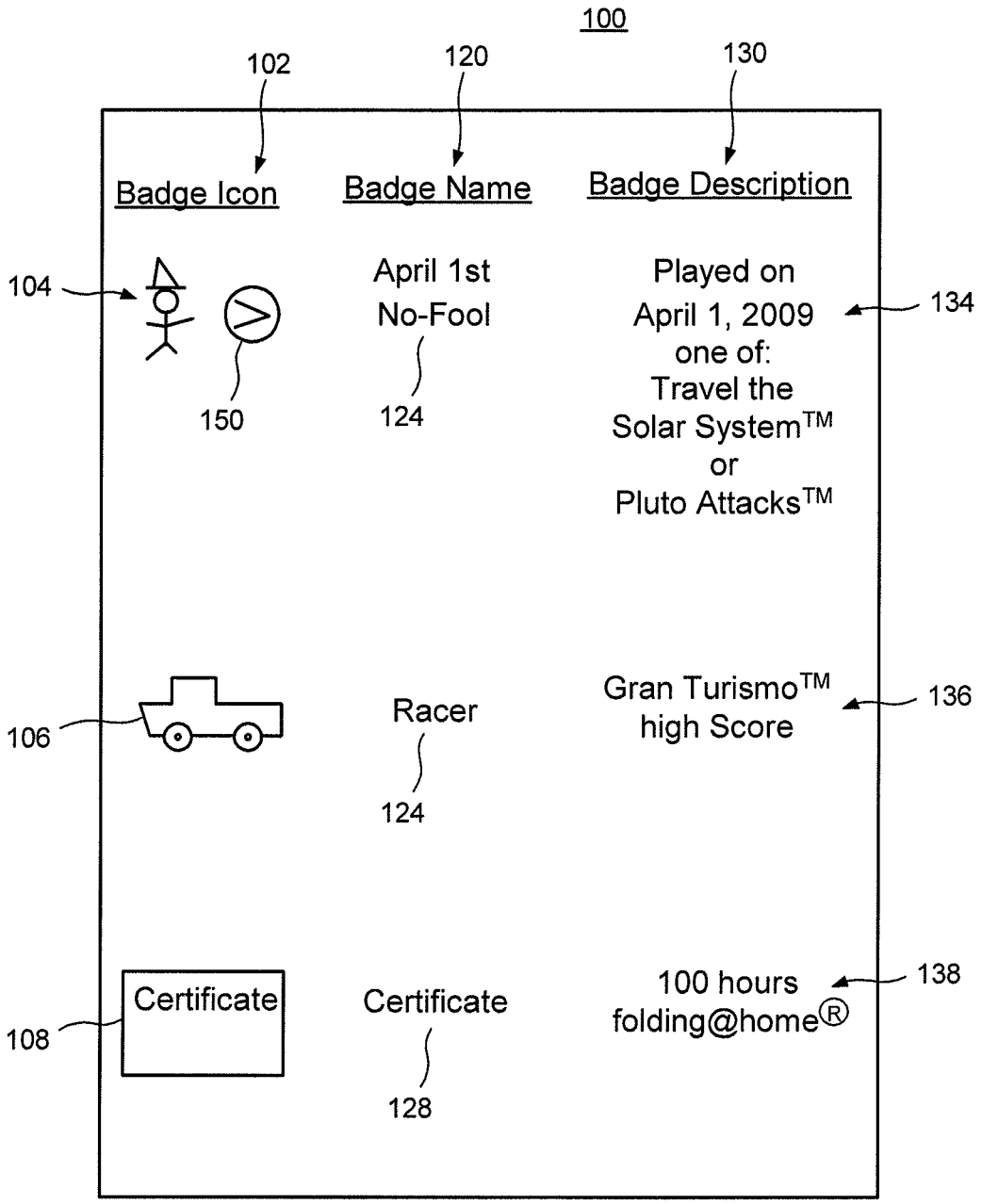
FIG. 1 illustrates an example of a display showing examples of badges according to an embodiment of the present invention.

FIG. 1 illustrates an example of a display 100 showing examples of badges according to an embodiment of the present invention. The display 100 is, for example, a combination of text, graphic and/or audio data that is displayed to a user and may be displayed on a GUI, computer monitor, processor screen of other electronic display apparatus. The display data 100 includes a badge category 102 that includes a representation of a badge, such as an icon, a name, or identifier of the badge, name category 120 and a description category 130.

As shown in FIG. 1, the badge category 102 shows a pictorial depiction of badges 104, 106 and 108. A corresponding name is shown in category 120 as elements 124, 126 and 128. Description category 130 shows a description of the badge such as an activity performed, accomplishment or the name of games that a user played to obtain the badge, elements 134, 136 and 138.

For example, the badge icon 104 is named "April 1st No-Fool" (124) and was obtained by the gamer, or user, playing at least one of TRAVEL THE SOLAR SYSTEM™ or PLUTO ATTACKS™, for example on Apr. 1, 2008 between 9 am and 12 noon EST, which is described by descriptive content 134. As shown in FIG. 1, badge 104 has an audio button 150 that may be used to access associated audio data for the badge 104. This audio data may include advertising data, advertising a product or service or may include a sound byte by a celebrity, or other audio data related to the badge or a sponsor of the badge or a previous owner of the badge.

Also as shown in FIG. 1, the badge icon 106 is named "Racer" (126) and was obtained by the gamer, or user, exceeding a preset minimum score playing GRAN TURISMO™, which is described by descriptive content 136.

Also as shown in FIG. 1, the badge icon 108 is named "Certificate" (128) and was obtained by the gamer, or user, exceeding a preset minimum number of hours of donated processing time in "Folding@home"®, which is described by descriptive content 138.

Badges may also be associated with an event such as the superbowl, world series, etc. This type of badge may be granted when the gamer plays a game or does some other activity. For example a superbowl badge may be awarded to all gamers who play a particular game during half-time of the superbowl.

The criteria for badges may include such things as playing a certain game during a certain time window; playing a game from a particular region (e.g., based on the zip code of the gamer or state, or country of the gamer); playing a certain number of hours; purchase of a specified product; spending a certain amount of money on gaming accessories and community service, such as Folding@Home®; playing a certain game over a certain number of years; video rental activity and other actions.

Figure 2:
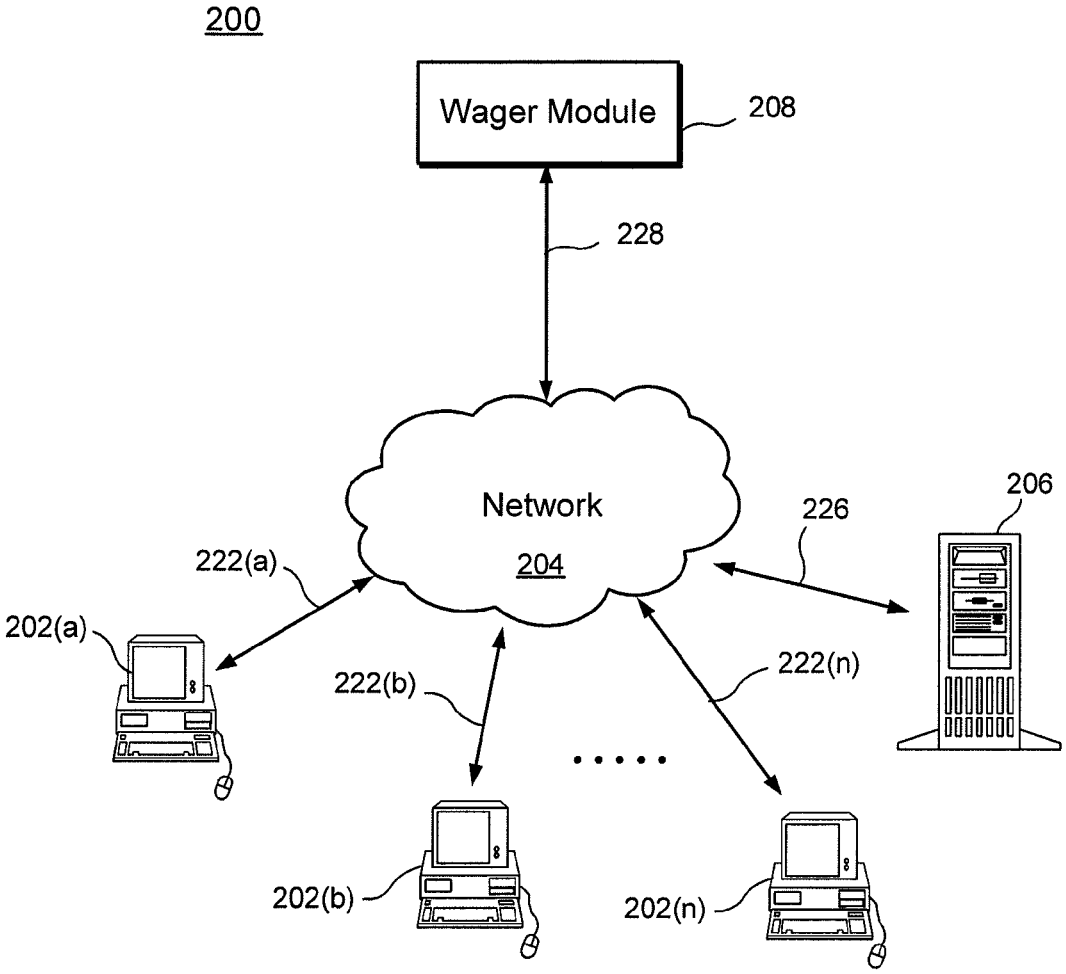
FIG. 2 illustrates an example of a network in which badges may be obtained and/or wagered and/or transferred according to an embodiment of the present invention.

FIG. 2 illustrates an example of a network environment 200 in which badges may be obtained and/or wagered according to an embodiment of the present invention.

Embodiments of the present invention may be implemented using one or more processing devices, or processing modules. The processing devices, or modules, may be coupled such that portions of the processing and/or data manipulation may be performed at one or more processing devices and shared or transmitted between a plurality of processing devices. For example, a user, or gamer may play against other users, or gamers over the network 200. The data processing may be performed by various module coupled to the network, either as the same unit or at a remote location.

Thus, an example of the invention is described in a network environment. Specifically, FIG. 2 shows a network environment 200 adapted to support various embodiments of the present invention. The exemplary environment 200 includes a network 204, a wager module, or facility, 208. (A module, as used herein, is for example, a series of instructions stored on a computer-readable, or an electronic storage medium storing program code, or a memory unit storing instructions that is coupled to an associated dedicated processing unit for execution of the instructions, the module may be a plug-in unit, stand alone set of instructions, or program code or may be an integral part of a larger component. Each module may be stored in a separate memory or a common computer memory.) FIG. 2 also show a plurality of terminals 202(*a*) . . . 202(*n*), where "n" is any suitable number and a kiosk 206.

The network 204 is, for example, any combination of linked computers, or processing devices, adapted to transfer and process data. The network 204 may be private Internet Protocol (IP) networks, as well as public IP networks, such as the Internet that can utilize World Wide Web (www) browsing functionality. An example of a wired network is a network that uses communication busses and MODEMS, or DSL lines, or a local area network (LAN) or a wide area network (WAN) to transmit and receive data between terminals. An example of a wireless network is a wireless LAN. Global System for Mobile Communication (GSM) is another example of a wireless network.

The GSM network is divided into three major systems which are the switching system, the base station system, and the operation and support system (GSM). Also, IEEE 802.11 (Wi-Fi) is a commonly used wireless network in computer systems that enables connection to the Internet or other machines that have Wi-Fi functionality. Wi-Fi networks broadcast radio waves that can be picked up by Wi-Fi receivers that are attached to different computers.

Wager module, or facility 208 may be for example a server computer operatively connected to network 204, via bi-directional communication channel, or interconnector, 228, which may be for example a serial bus such as IEEE 1394, or other wire or wireless transmission medium. The terms "operatively connected" and "operatively coupled", as used herein, mean that the elements so connected or coupled are adapted to transmit and/or receive data, or otherwise communicate. The transmission, reception or communication is between the particular elements, and may or may not include other intermediary elements. This connection/coupling may or may not involve additional transmission media, or components, and may be within a single module or device or between the remote modules or devices.

The wager module 208 is adapted to transmit data to, and receive data from, terminals 202(*a*) . . . (*n*) and kiosk 206, via the network 204. Wager module 208, which may be a server computer, is described in more detail with reference to FIG. 3, herein.

Terminals 202(*a*) . . . (*n*) (where "n" is any suitable number) (generally referred to as 202) are coupled to network 204 via an associated bi-directional communication medium 222(*a*) . . . (*n*), which may be for example a serial bus such as IEEE 1394, or other wire or wireless transmission medium. Terminals 202 may be communication appliances, or user locations, or subscriber devices, or client terminals. For example, terminals 202 may be computers, or other processing devices such as a desktop computer, laptop computer, personal digital assistant (PDA), wireless handheld device, PLAYSTATION™, PSP™ and the like. They may be capable of processing and storing data themselves or merely capable of accessing processed and stored data from another location (i.e., both thin and fat terminals).

Terminal 202(*a*) may be a user terminal at which a user competes for badges and can display the user's badges as well as other information. Terminal 202(*a*) may be a home computer or gaming terminal.

Terminal 202(*n*) may be a terminal at a public location, or available to rent while a user is gaming. Kiosk 206 is also adapted and capable of being used as a gaming terminal and may be for example a PLAYSTATION™ unit adapted to be used by gamers at the location of the kiosk. The kiosk 206 may be located at a street corner of a city the gamer is visiting and wishes to play while away from home. Thus, a user may access the wagering system at kiosk 206. The kiosk 206 is coupled to network 204 via bi-directional communication medium 226.

Terminals 202 typically include a display unit and an input unit. The display unit is used to display the data generated by the system 200 as well as input generated at the terminal 202, and the network 204. The display unit of terminal 202 may be, for example, a monitor, LCD (liquid crystal display), a plasma screen, a graphical user interface (GUI) or other unit adapted to display output data typically by a representation of pixels to form text and graphic and video data and/or audio data via associated speakers (speakers not shown). The input unit may include devices such as a keyboard, mouse, track ball and/or touch pad or any combination thereof.

The display unit of terminal 202 may display generated at other components of the network 204. Specifically, data generated at wager module 208 may be displayed at the terminal display units.

The wager module 208 and terminals 202 and kiosk 206 typically utilize a network service provider, such as an Internet Service Provider (ISP) or Application Service Provider (ASP) (ISP and ASP are not shown) to access resources of the network 204.

Figure 3:
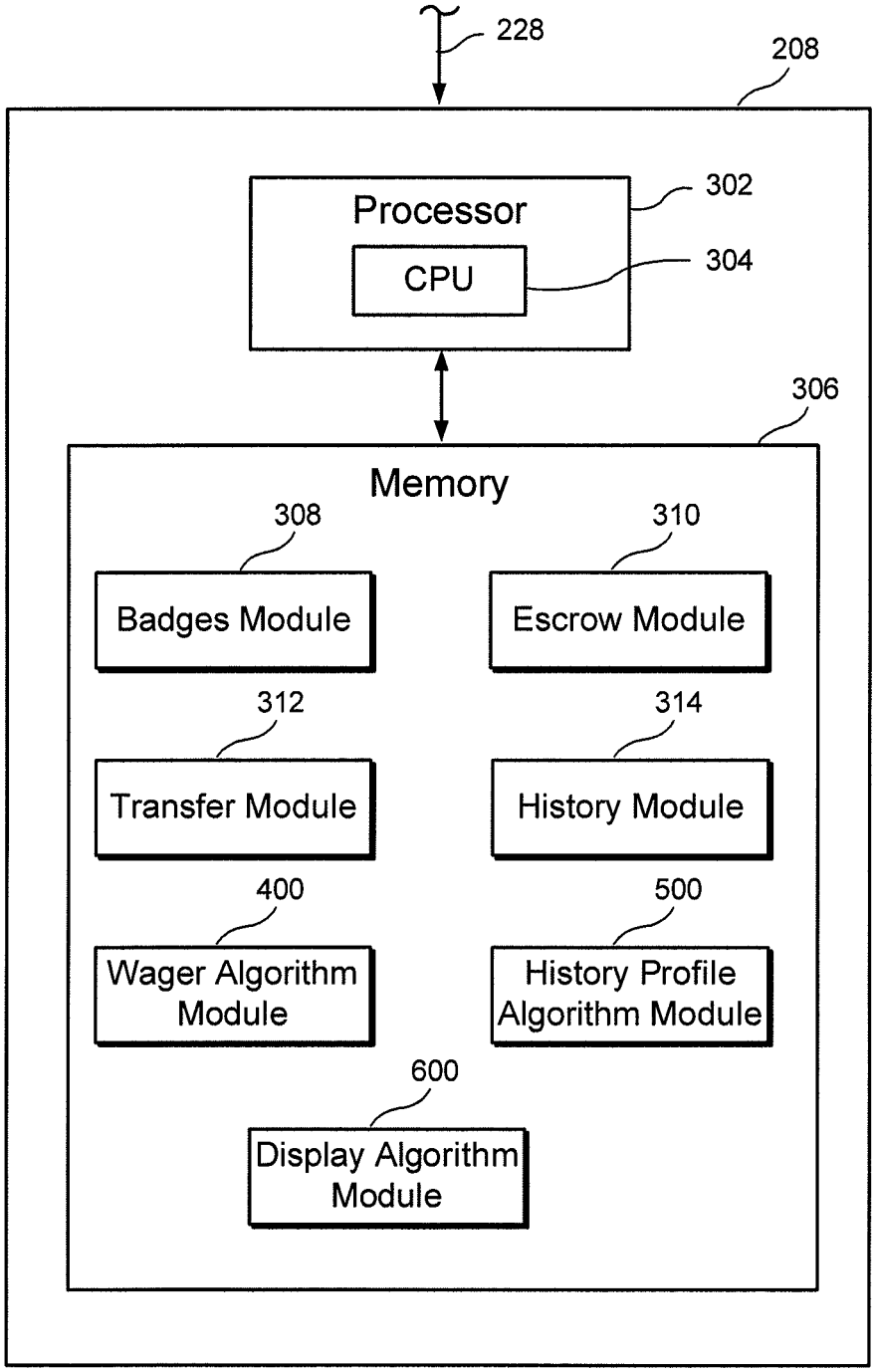
FIG. 3 illustrates an example of a processing apparatus for transacting a wager between gamers.

FIG. 3 illustrates an example of wager module 208, which is a module (processor, electronic storage medium, program code and electronic data) for transacting a wager between gamers. The wager module 208 includes a processor module 302, a memory module 306, badges module 308, escrow module 310, transfer module 312, history module 314, wager algorithm module 400, history profile algorithm module 500 and display algorithm module 600. Wager module 208 is coupled to network (204 in FIG. 1) via bi-direction communication medium 228.

Processor module 302 is coupled to memory module 306 via an associated communication link to enable processor module 302 to coordinate processing operations of the modules 308, 310, 312, 314, 400, 500 and 600. These module may be a memory location that may also include a dedicated processor, or may use processor 302 to process the data. The processor module 302 includes a CPU 304, which is typically a processor that includes an arithmetic logic unit (ALU), which performs arithmetic and logical operations, and a control unit (CU), which extracts instructions from memory and decodes and executes them, utilizing the ALU when necessary. An I/O interface may be used to operatively couple the components of processor module 302.

Memory 306 stores programs, which include, for example, a web browser, algorithms, as well as typical operating system programs (not shown), input/output programs (not shown), and other programs that facilitate operation of wager module 208. The web browser (not shown) is for example an Internet browser program such as Internet Explorer™. Memory module 306 may be, for example, an electronic storage medium, such as another electronic storage repository that can store data used by wager module 208. The memory module 306 may include, for example, RAM, ROM, EEPROM or other memory media, such as an optical disk, optical tape, CD, or a floppy disk, a hard disk, or a removable cartridge, on which digital information is stored in the form of bits. The memory module 306 may also be remote memory coupled to processing module 302 via wired or wireless bi-directional communication medium.

Badges module 308 includes memory to store program code and badge, or symbol, data. This badge data includes, for example, requirements for a gamer to obtain a particular badge and a record of badges for each gamer. The requirements for a badge may include, for example, playing a particular game on a certain day, reaching a minimum score in a particular game. The badge module may also store graphic data to represent the badges as an icon or other graphic. The badges module 308 may also store audio data associated with particular badges as well as associated identification, class and/or status information.

The requirements for a badge may be predetermined; but the badge issued after the time for fulfilling the requirements has expired. For example, a badge may be provided to all players who played a particular game on April 1$^{st}$. However, issuance and notification of the badge may be withheld until April 2$^{nd}$. Thus, the gamer had no knowledge that by playing a particular game on a certain day, they would earn a badge. (See FIG. 1 for an example of the badge 104 and the description 134). Other requirements may be posted to gamers in advance explaining what must be done to obtain the badge.

Thus, badges have an "unexpected" quality, or "random" quality that may not necessarily be related to a skill level of the gamer. Alternatively, some badges have a direct relationship to a level of proficiency of the gamer and can be obtained, for example, by meeting minimum score requirements of a game.

Escrow module 310 includes memory to store program code and memory to store badges that are being wagered, or placed at stake by a user. The escrow module 310 ensures that the user has the badge at stake and does not permit the user to wager or otherwise dispose of a badge that has already been wagered. Thus, when a contest or competition or challenge is made all contestants will place the badges wagered (at stake) into escrow.

Transfer module 312 includes memory to store program code and memory to store wager data such as an identification of gamers who wish to wager, the contest, challenge or competition, and the badges that are at stake for each gamer. The transfer module 312 can also determine the outcome of the wager and move the badges to the appropriate account based on the outcome.

History module 314 includes memory to store program code and memory to store history data for each badge. The history data may include the badge name, date of issuance, current holder, each previous holder, duration of each previous holder, and how the badge was transferred between each holder. The history profile is explained in more detail in relation to FIG. 5 and FIG. 6 herein.

Wager algorithm module 400 is a memory module used to store an algorithm for gamers to wager badges. This algorithm is described in relation to FIG. 4.

History profile algorithm module 500 is a memory module used to store an algorithm to identify and wager badges and update the profile according to the outcome of the wager. This algorithm is described in relation to FIG. 5.

Display algorithm module 600 is used to generate display data to be displayed at a user terminal that shows badges, badge history and other data. Display data is described in more detail in relation to FIG. 6.

Figure 4:
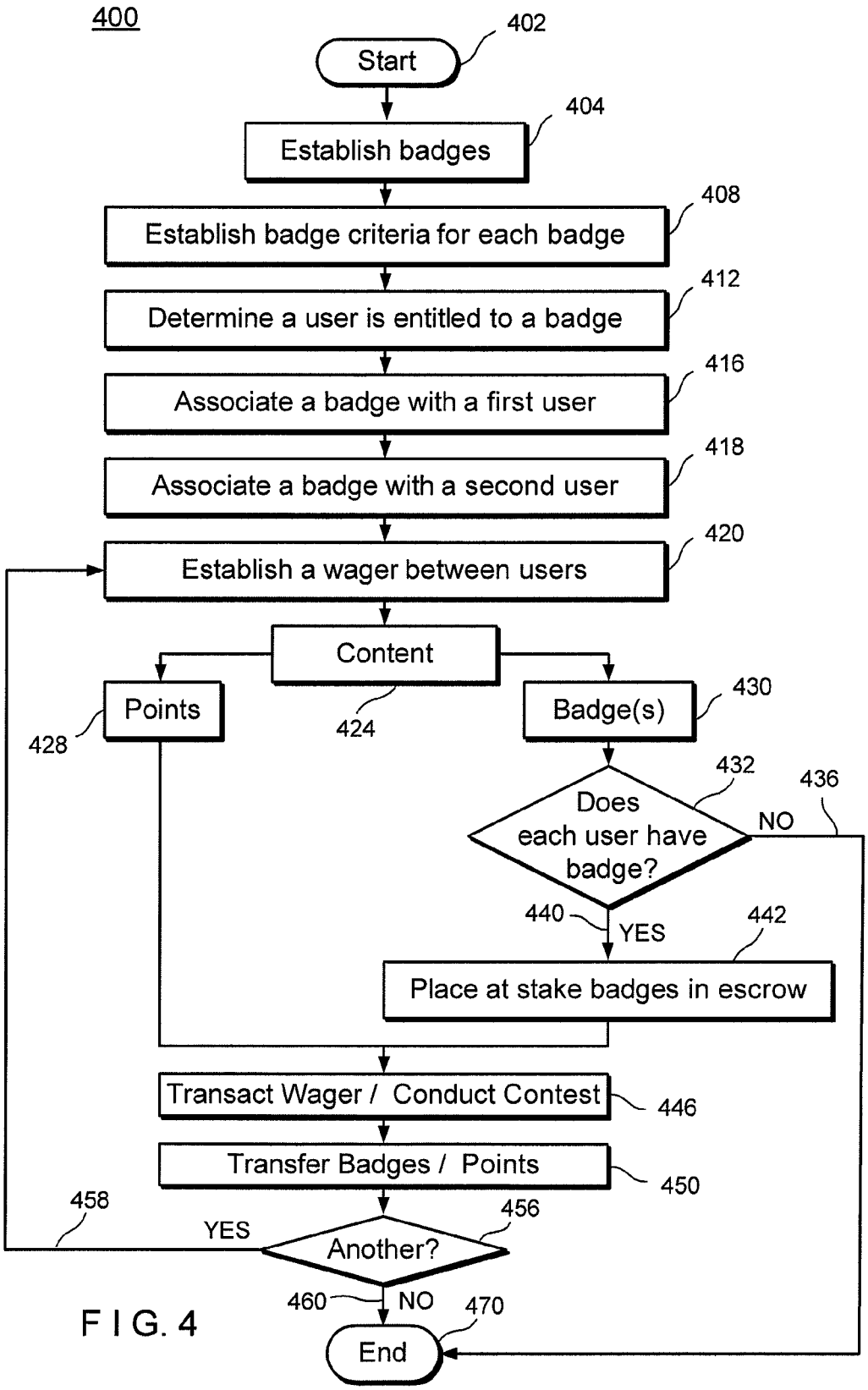
FIG. 4 shows an example of an algorithm used to wager badges according to an embodiment of the present invention.

FIG. 4 shows an example of an algorithm used to wager badges according to an embodiment of the present invention. As shown in FIG. 4, the algorithm may be illustrated as a flowchart of steps 400 to implement an embodiment of the present invention. The steps 400 may be executed by a processor, or otherwise executed to perform the identified functions and may also be stored in one or more memories and/or one or more electronic and/or computer-readable media. For example, the steps of FIG. 4 may be stored on a computer-readable medium, such as ROM, RAM, EEPROM, CD, DVD, or other non-volatile memory. The program code stored on an electronic memory medium is a structural element. The process 400 begins with start step 402.

A badge is established, as shown in step 404. Badge characteristics, such as shape, color, audio content may be associated with the badge. Badge criteria are established as shown in step 408. The badge criteria are requirements for a user, or gamer, to obtain a badge. The badge criteria may be established based on a skill achievement or a non-skill occurrence.

Step 412 determines whether a user has met the requirements for a particular badge. For example, a gamer may meet the criteria of playing a game for more than 10 hours within 10 days, thereby obtaining an associated badge for that accomplishment. Furthermore, the user's badges are checked in the event that the user wishes to wager a badge. In this situation confirmation is made that the user has the badge that is being wagered against another user(s).

A badge that has been awarded to a user is associated with the user, as shown in step 416. This enables a user to collect badges for future wagers and display on a user account.

Step 418 shows that many gamers may obtain badges for which they meet the criteria. Each gamer is associated with their particular badges.

A wager, or challenge or contest may be established between two or more gamers, as shown in step 420. Typically a wager is a bet, or gamble, for example, two gamers racing in an on-line race. A challenge is when one user dares or challenges one or more other gamers to meet or exceed a metric, for example a gamer challenges another gamer to obtain at least a certain minimum score in a game. A contest may be open to gamers to attempt to meet a certain criterion.

The content of the wager is established as shown in step 424. The content may be points (428) and/or badges (430).

Decision step 432 determines whether or not the gamers have possession, or own, the badges they are putting at stake for the wager, challenge, contest or competition. If not, "no" line 436 leads to end step 470 and any gamer who does not have the badge they put at stake is not permitted to wager. If a gamer has the badge he/she is putting at stake, "yes" line 440 shows that the badges at stake are placed in escrow, as shown in step 442.

The wager is transacted such that an outcome is reached, as shown in step 446. For example the contest between gamers occurs, the time expires for a gamer to meet a challenge or other termination of the wager.

Step 450 shows that the badges and/or points that were at stake are transferred to gamers' accounts based on the outcome of the wager.

A determination is made whether another wager is desired, as shown in step 456. If so, "yes" line 458 leads to step 420. If there are no more wagers, "no" line 460 leads to end step 470.

Figure 5:
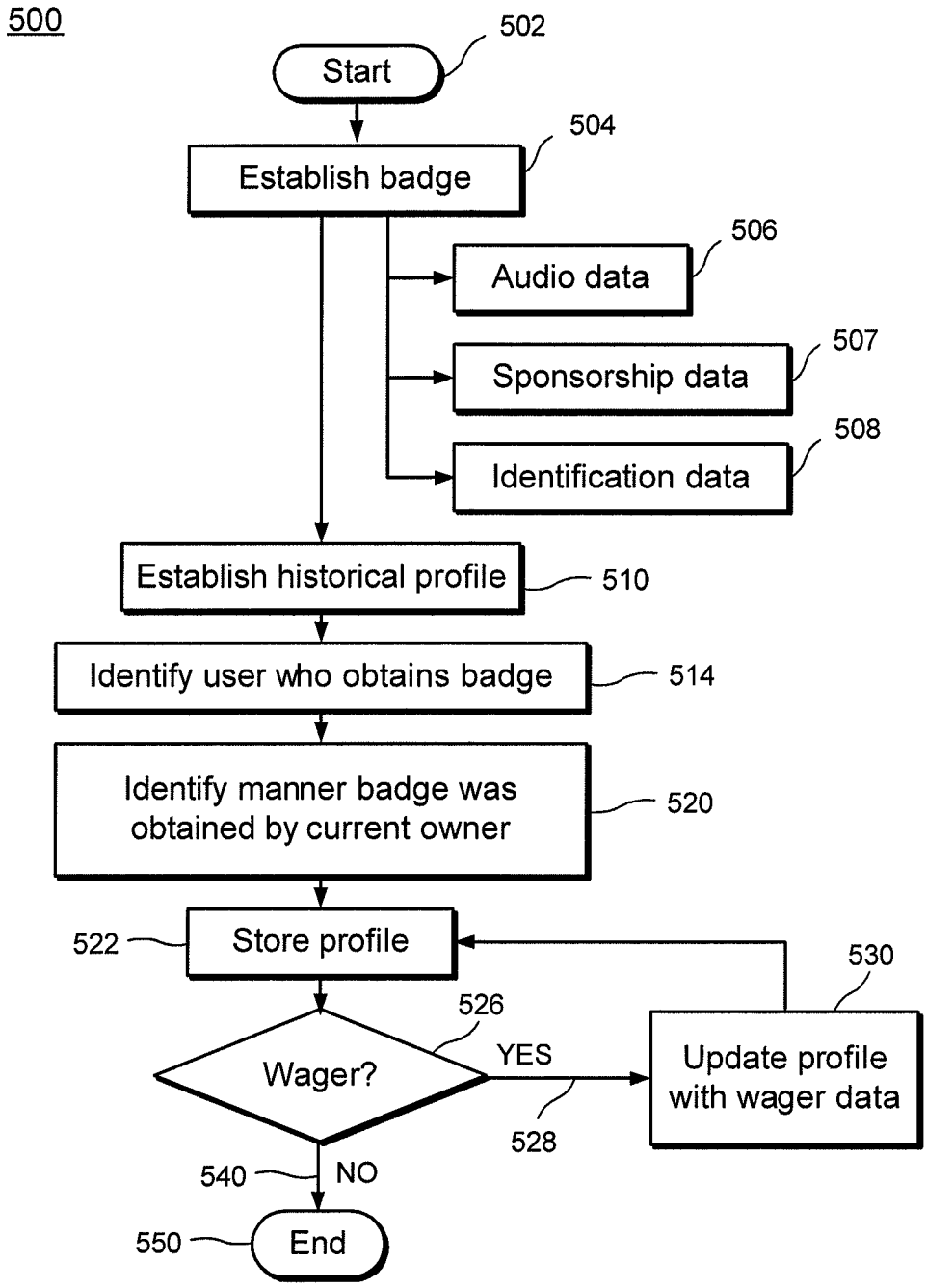
FIG. 5 shows another example of an algorithm used to wager badges and update a historical profile according to an embodiment of the present invention.

FIG. 5 shows another example of an algorithm used to wager badges according to an embodiment of the present invention. As shown n FIG. 5, a series of steps may be represented as a flowchart 500 that may be executed by a processor, or otherwise executed to perform the identified functions and may also be stored in one or more memories and/or one or more electronic and/or computer-readable media. For example, the steps of FIG. 5 may be stored on a computer-readable medium, such as ROM, RAM, EEPROM, CD, DVD, or other non-volatile memory. The program code stored on an electronic memory medium is a structural element. The process 500 begins with start step 502.

A badge is established, as shown in step 504. This establishment step includes determining badge characteristics, such as shape, color, audio content (506), sponsorship data (507) and/or identification data (508) that may be associated with the badge. Badge criteria are also established that are the requirements for a user, or gamer, to obtain a badge. The badge criteria may be established based on a skill achievement or a non-skill occurrence.

An historical profile of a badge is established as shown in step 510. The historical profile may include information about previous holders of the badge, such as an audio clip, video clip, what the wagers were, what other badges were at stake, how long each previous holder had the badge and other indicia of the ownership of the badge.

Step 514 shows that a current owner of the badge is identified and step 520 identifies the manner that the badge was obtained (i.e., contest, earned by skill, earned by "random" event such as playing a particular game on a particular day).

The profile for each badge is stored, as shown in step 522. Step 526 shows that the badge may be the subject of a wager. If so, "yes" line 528 shows that the history of the badge is updated based on the outcome of that wager, as shown in step 530 and the updated badge profile is stored, as shown in step 522. If the badge is not wagered, end step 550 is reached. The history of the badge may be stored at a memory location such that a previous owner of the badge may trace any and all subsequent owners of that badge. Thus, an owner who lost a badge in a wager or transaction to one person (who may have subsequently lost the badge to other people) can trace the current holder of the badge and attempt to re-win or reclaim the badge through a wager or transaction with the current holder. Thus, even though a badge holder may lose a badge the lost badge can be traced so that a previous owner has an opportunity to own the badge again.

As stated previously, the badges according to embodiments of the present invention may be a "collector's item" for the player. The badges may be earned not necessarily for skill level, but out of luck, for special events, etc., and do not possess any sort of numerical or economic value to impact the player's standing such as a PlayStation®Network level.

The concept of wagering badges—symbols of one's achievements not only in-game, but across the PlayStation®Network as a whole—takes playing games out of the game and onto a broader network, truly achieving the meaning of 'playing online'. The ability for players to play against one another with their hard-earned badges at stake, even when those badges are not related to the game being played, adds excitement and dynamics to the gaming experience.

An example of an algorithm according to an embodiment of the present invention is as follows:

- Player A logs onto the online gaming server and creates an online match, for example by using a match creation page, player A is required to enter match details. The details may include:
  - Would you like to add a wager to this game? (Y/N)
    - If 'No', game is created with no wager in place.
    - If 'Yes', next option appears
  - What would you like to add as a wager? (In-game Item/Points/PlayStation® Network Badge)
    - If 'In-game Item' is selected player's in-game item collection window appears and player can select which item to offer as wager.
    - If 'Points' is selected player can enter how many game points he/she wants to bet in the game
    - If 'PlayStation® Network Badge' is selected player's badge collection window appears and player can select which badge(s) to offer as wager.
  - After selecting wager, game is created.
- Player B logs onto the online gaming server and joins the game Player A has created. If the game has a wager, wagered badge/in-game item/points appear on Player B's screen and Player B is prompted to offer wager as well.
  - In the case of wagering points, Player B can only bet same number of points or higher. If Player B offers more points, Player A receives the option of matching the points offered or leaving the match.
  - In the case of wagering an in-game item or badge, once Player B makes an offer, Player A receives the option of accepting, countering, or declining the offer.
    - If Player A counters Player B's wager, Player B can either offer another wager, or leave the match.
    - If Player A declines Player B's wager, Player A leaves the match.
    - If Player A accepts Player B's wager, the online match begins.

While wagering badges is one way to transact or obtain badges from others, gamers may also trade badges without wagering. This trading may be accomplished by a gamer viewing a listing of another gamer's badges and establishing a trade of badges between the gamers.

Some badges may be designated as not being available for wager or trade. Typically, this is accomplished by associating a flag with the badge that identifies that the badge has this restricted status.

It is also an embodiment of the present invention that the badges are classified, or organized into predetermined classes or groups. Once a gamer has achieved or obtained all the badges in the class, he/she may receive a collective badge, that represents that all badges of a class have been obtained.

It is also an embodiment of the present invention that gamers can make search queries of other gamers to identify what badges other gamers posses and whether they are willing to trade/wager their badges.

It is also an embodiment of the present invention that a badge may have an identifier that indicates how rare, or unusual the badge is. For example, a badge may have a numerical identifier that identifies that the badge is number 380 of 600 badges of that type. The rarity of the badge may increase its desirability for wagering and/or trading.

Furthermore, some badge, typically those obtained by a skill accomplishment rather than those obtained by a non-skill achievement, may have an associated skill level and percentage remaining before reaching the next level. For example the badge may be a "level 5 20%" meaning that until the gamer reaches 100% he/she can not reach level 6 for that badge. This provides motivation for the gamer to reach the next level, since that would increase the status of the badge.

It is also an embodiment of the present invention that a matching algorithm may be used to match badges and games so that a gamer may search for gamers who desire to wager certain badges for certain contests. For example, gamers may wish to seek other gamers to compete in WARHAWK™. The gamers can also seek out desired badges that other gamers have. This searching may also be restricted to a "friends network" thereby facilitating a sense of community among gamers.

It is also an embodiment of the present invention that a descriptor may be associated with each badge that describes how the badge was obtained. This descriptor may include the criteria and/or history of the badge. (This is described in more detail with reference to FIG. 6 herein.) The descriptor indicates whether the badge was earned by the owner or holder or won by the owner or holder. For example, a badge may be earned by a holder or owner by the owner or holder performing a specified task, or reaching a certain score on a game or other achievement related to the badge that resulted in the acquisition of the badge. A badge may be won by the owner or holder by the owner or holder having a favorable outcome of a wager in which the badge was at stake. Thus, the way that the badge was acquired is provided as the descriptor that is associated with the badge. Furthermore, badge history data may be generated by accumulating who obtains each badge. Thus, if an owner of a badge loses a wager and must convey the badge the owner can trace the subsequent owner or owners of the badge to determine the present owner of a badge.

It is also an embodiment of the present invention that a badge may be sponsored by a third party. For example, a corporation may establish a badge that may be obtained by buying products sold by the corporation. The badge may also include an audio advertisement that is played when the badge is displayed to a gamer. The gamer who receives such a badge may also receive, for example, a coupon that may be redeemed for a discount price on a product, free product, or other value.

It is also an embodiment of the present invention that a dedicated website include data related to new badges and opportunities to obtain badges. For example the website may identify a badge that is available on a certain day by playing a certain game. Alternatively, as stated previously, the badge may be "random" in that the criteria are not displayed and gamers obtain the badge by unknowingly fulfilling the criteria. Another example of obtaining a badge is that a gamer may receive a badge for donating processing time such as the Folding@Home™ project, in which Sony Computer Entertainment® offers an environment for distributed computing applications. This environment provides a valuable resource for academic research in a wide variety of fields. Thus, a gamer may obtain a "Folding@Home™" badge by participating in this activity.

It is also an embodiment of the present invention that badges may be traded for virtual gaming accessories (such as a virtual clothing article, such as a hat, or virtual weapon such as a sword to be used in another video game) or coupons for other products, such as videos, CDs, DVDs.

It is also an embodiment of the present invention that badges may be wagered in a public forum, either actual or virtual (via a website) in which observers and spectators can view the wagering of other gamers. This viewing feature includes watching the other gamers identify the badges at stake, observing the competition and seeing the transfer of badges between the competing gamers. This may include requiring gamers who wish to have their wagers viewed by other to exceed certain minimum thresholds for badge levels and/or experience.

Figure 6:
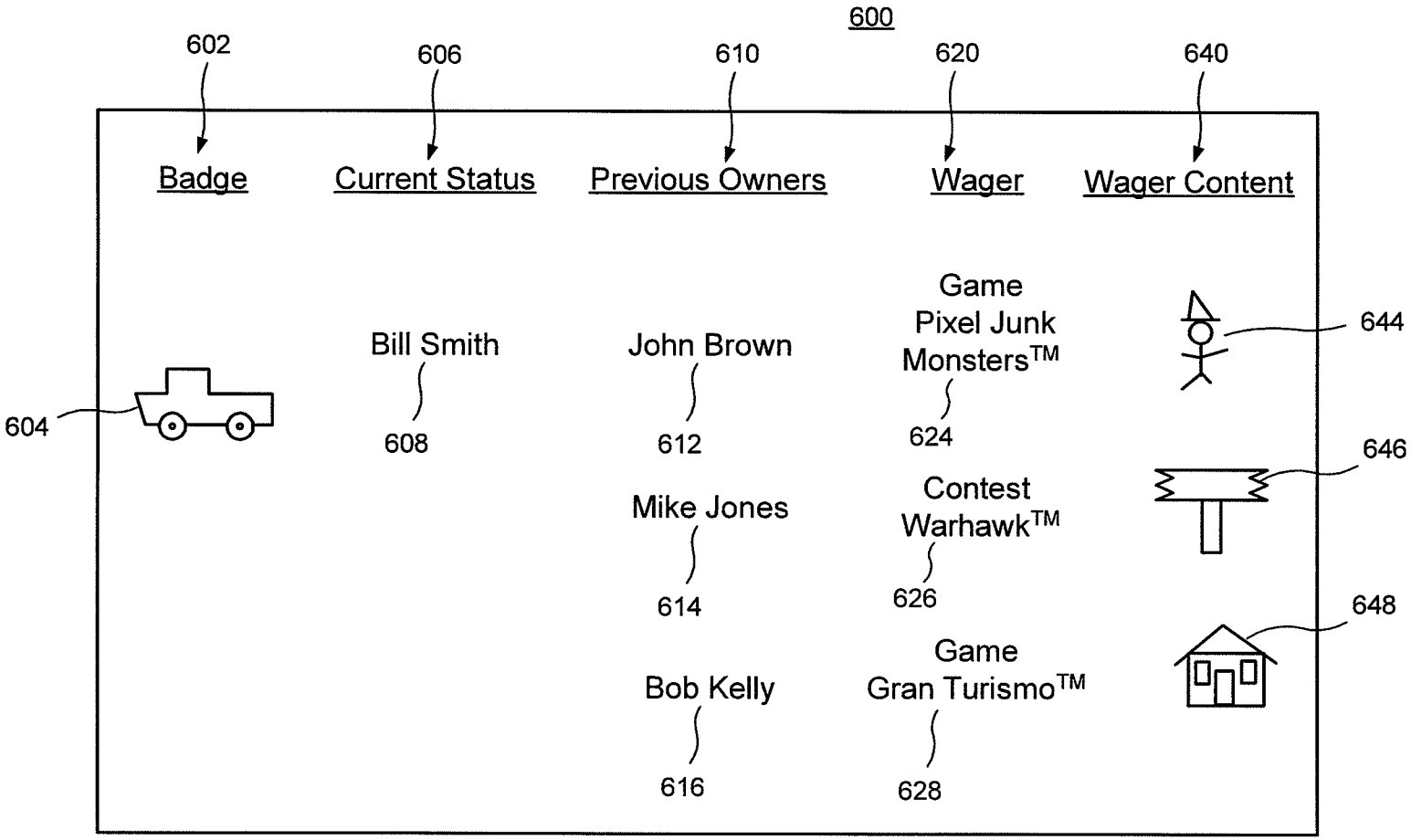
FIG. 6 shows an example of a display that may be used to illustrate the previous and current status of various badges according to an embodiment of the present invention.

FIG. 6 shows an example of a display 600 that may be used to illustrate the previous and current status of various badges according to an embodiment of the present invention.

As shown in FIG. 6, display 600 includes badge category 602, current status category 606, previous owners category 610 wager type category 620 and other badges that were at stake in previous wagers 640.

Badge category 602 shows that a "car" badge 604 is displayed and has a current owner of "Bill Smith" (608). Previous owners "John Brown" (612) "Mike Jones" (614) and "Bob Kelly" (616) are also shown. The former wagers are also shown (i.e., PIXEL JUNK MONSTERS™ (624); a contest in WARHAWK™ (626) and a game of GRAN TURISMO™ (628)). The badges that were at stake are shown as icons 644, 646 and 648.

An embodiment of the invention also keeps track of each badge that a gamer had at any time so that each gamer can trace previously owned badges to see who has their former badge and how the current owner obtained it. This enables gamers to attempt to recoup their former badges, if they desire.

It will be appreciated from the above that the invention may be implemented as computer software, which may be supplied on a storage medium or via a transmission medium such as a local-area network or a wide-area network, such as the Internet. It is to be further understood that, because some of the constituent system components and method steps depicted in the accompanying Figures can be implemented in software, the actual connections between the systems components (or the process steps) may differ depending upon the manner in which the present invention is programmed. Given the teachings of the present invention provided herein, one of ordinary skill in the related art will be able to contemplate these and similar implementations or configurations of the present invention.

It is to be understood that the present invention can be implemented in various forms of hardware, software, firmware, special purpose processes, or a combination thereof. In one embodiment, the present invention can be implemented in software as an application program tangible embodied on a computer readable program storage device. The application program can be uploaded to, and executed by, a machine comprising any suitable architecture.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

What is claimed is:

1. A method for transacting one or more symbols comprising:

establishing one or more first symbols obtainable in a first game title;

establishing first predetermined criteria for the one or more first symbols;

determining that a first user is entitled to one or more particular first symbols based on the first predetermined criteria;

establishing one or more second symbols obtainable in a second game title, the second game title being different from the first game title across a network of games and the second symbols being different from the first symbols;

establishing predetermined second criteria for the one or more second symbols;

determining that a second user is entitled to one or more particular second symbols based on the second predetermined criteria;

associating the first user with one or more first particular symbols;

associating the second user with one or more second particular symbols;

establishing a transaction between the first user and the second user, the transaction utilizing (1) one or more first particular symbols wagered by the first user and (2) one or more second particular symbols wagered by the second user and (3) a competition, wherein the competition is a challenge where the first user challenges the second user to meet or exceed a metric; and transferring the utilized one or more first or second symbols based on the transaction.

2. The method as claimed in claim 1, wherein the predetermined criteria is related to a time period that a particular first symbol or second symbol is available for acquisition by one or more users.

3. The method as claimed in claim 1, wherein the predetermined criteria is related to activities by one or more users.

4. The method as claimed in claim 1, wherein selected first symbols are associated with a skill level and selected second symbols are associated with a skill level.

5. The method as claimed in claim 1, further comprising:

establishing an electronic escrow account for the first user and the second user to store the utilized first particular symbols for the first user and the utilized second particular symbols for the second user.

6. The method as claimed in claim 1, wherein the transaction comprises an activity between the first user and the second user.

7. The method as claimed in claim 1, wherein the transaction comprises an activity by one of the first user or the second user.

8. The method as claimed in claim 1, wherein the step of establishing the transaction comprises:

identifying items and/or first and second particular symbols to be transacted; and wherein the transferring step comprises determining whether to transfer the identified items and/or first and second particular symbols based on the transaction.

9. The method as claimed in claim 1, further comprising:

establishing an indication associated with each first particular symbol and each second particular symbol obtained by the respective first and second users, the indication based on a manner in which the respective first or second particular symbol was obtained.

10. The method as claimed in claim 1, wherein each first particular symbol and each second particular symbol includes an historical profile of the respective particular symbol.

11. The method as claimed in claim 1, wherein one or more of the first symbols or second symbols include audio data.

12. The method as claimed in claim 1, further comprising:

monitoring an ownership status of one or more first symbols and the one or more second symbols.

13. The method as claimed in claim 1, wherein each first symbol and each second symbol has an associated class.

14. The method as claimed in claim 1, wherein each first symbol and each second symbol has an associated number.

15. The method as claimed in claim 1, further comprising:

wherein audio advertising information is played when the one or more particular first symbols or the one or more particular second symbols is displayed to any user, wherein a third party establishes the one or more particular first symbols or the one or more particular second symbols and the associated advertising information.

16. The method as claimed in claim 1, further comprising:

associating a particular status with each first particular symbol and each second particular symbol, wherein the status determines a type of transaction associated with the respective symbol.

17. A method for transacting one or more symbols comprising:

associating one or more first particular symbols with a first user, the first particular symbol representing an achievement earned by the first user in a first game title;

associating one or more second particular symbols with a second user, the second particular symbol representing an achievement earned by the second user in a second game title, the second game title being different from the first game title across a network of games and the second symbols being different from the first symbols;

establishing a transaction between the first user and the second user, the transaction utilizing (1) the first particular symbol wagered by the first user, and (2) the second particular symbol wagered by the second user, and (3) a competition, wherein the competition is a challenge where the first user challenges the second user to meet or exceed a metric; and transferring the utilized first or second particular symbol wagered based on the transaction.

* * * * *